US010731381B2

(12) United States Patent
Zhang

(10) Patent No.: US 10,731,381 B2
(45) Date of Patent: Aug. 4, 2020

(54) LOCKSET

(71) Applicant: SINOXLOCK (KUNSHAN) CO., LTD, Kunshan, Jiangsu (CN)

(72) Inventor: Xiao-Di Zhang, Jiangsu (CN)

(73) Assignee: SINOXLOCK (KUNSHAN) CO., LTD, Kunshan (CN)

( * ) Notice: Subject to any disclaimer, the term of this patent is extended or adjusted under 35 U.S.C. 154(b) by 112 days.

(21) Appl. No.: 16/018,642

(22) Filed: Jun. 26, 2018

(65) Prior Publication Data

US 2018/0371794 A1 Dec. 27, 2018

(30) Foreign Application Priority Data

Jun. 27, 2017 (TW) ..... 106209359 U

(51) Int. Cl.

| | |
|---|---|
| ***E05B 37/02*** | (2006.01) |
| ***E05B 65/52*** | (2006.01) |
| ***A45C 13/18*** | (2006.01) |
| ***E05B 37/16*** | (2006.01) |

(52) U.S. Cl.

CPC ..... *E05B 37/02* (2013.01); *E05B 37/16* (2013.01); *E05B 65/52* (2013.01); *E05B 65/5261* (2013.01); *A45C 13/18* (2013.01)

(58) Field of Classification Search

CPC ..... Y10T 24/3405; Y10T 24/3407; Y10T 292/096; Y10T 292/1043; Y10S 292/48; Y10S 292/50; E05B 37/02; E05B 65/52; E05B 37/16; E05B 65/5261; E05B 37/12; E05B 65/48; E05B 65/50; E05B 65/5269; E05B 65/5276; E05B 65/5284; A45C 13/18

USPC ..... 70/63–76, 312, 304, DIG. 63; 150/101, 150/102; 190/101, 118–122, 903

See application file for complete search history.

(56) References Cited

U.S. PATENT DOCUMENTS

| | | | |
|---|---|---|---|
| 4,068,873 | A | 1/1978 | Testa et al. |
| 4,074,549 | A | 2/1978 | Yee |
| 4,155,234 | A | 5/1979 | Bako |
| 4,761,974 | A | 8/1988 | Lii |
| 4,920,771 | A | 5/1990 | Jiang |
| 5,438,853 | A | 8/1995 | Bartsch |

(Continued)

FOREIGN PATENT DOCUMENTS

CN 205224873 U 5/2016

OTHER PUBLICATIONS

Office Action dated Dec. 8, 2017 from U.S. Appl. No. 15/354,068.

*Primary Examiner* — Lloyd A Gall
(74) *Attorney, Agent, or Firm* — Innovation Capital Law Group, LLP; Vic Lin

(57) ABSTRACT

The lockset includes a first body, a second body and a third body. The first body includes a connecting part, a first A part, and a first B part. The first A part includes a first A lock body, a first A upper face having a first A lock hole, and a first A side face having a first A positioning hole. The first B part includes a first B upper face having a first B lock hole and a first B side face having a first B positioning hole. The second body includes a second upper face having a second rotatable buckle and a second side face having a second positioning unit. The second rotatable buckle has a second rotating unit and a second lock unit. The third body includes a third upper face having a third rotatable buckle and a third side face having a third positioning unit.

16 Claims, 13 Drawing Sheets

(56) References Cited

U.S. PATENT DOCUMENTS

| | | | | |
|---|---|---|---|---|
| 5,485,734 | A | 1/1996 | Yang | |
| 5,692,403 | A | 12/1997 | Ling | |
| 5,713,226 | A | 2/1998 | Yu | |
| 6,173,592 | B1 | 1/2001 | Yu | |
| 2005/0109072 | A1* | 5/2005 | Ling | E05B 37/02 70/68 |
| 2008/0041126 | A1* | 2/2008 | Yu | A44B 11/2573 70/58 |
| 2017/0138093 | A1 | 5/2017 | Wu | |
| 2019/0271176 | A1* | 9/2019 | Song | E05C 3/28 |

* cited by examiner

LOCKSET

BACKGROUND OF THE INVENTION

1. Field of the Invention

The present invention generally relates to a lockset for use with a case.

2. Description of the Prior Art

FIG. 1A shows that users usually load items in a case 20 with a lockset 90 to secure their luggage while traveling. Wherein, the case 20 could be but not limited to a luggage case, a suitcase or a briefcase. Conventionally, the lockset 90 includes a combination lock or a key lock, and users can unlock the lockset 90 to open the case 20 by rotating at least one number dial to the right combination or using a matching key. Wherein, the combination lock includes an unlock button 91 to be pressed to unlock the lockset 90 after rotating the number dials to the right combination.

Furthermore, the lockset 90 could be used with a zipper 40 of the case 20. To secure the zipper 40 with the lockset 90, sliders 41 of the locked zipper 40 can be inserted or embedded into grooves 92 of the lockset 90, and a movable pin or a latch comes through the holes of the sliders 41. To open the case 20, the movable pin or the latch can be released from the holes of the sliders 41 by unlocking the lockset 90, and the sliders 41 separated from the grooves 92 of the lockset 90 can be moved to unlock the zipper 40.

However, the lockset 90 protruding from the surface of the case 20 could be broken by impact or other causes while travelling. Furthermore, when the lockset 90 is used with the zipper 40 of the case 20, the locking function might become invalid because of damaged sliders 41.

Moreover, FIG. 1B shows that for a thickened case 70 having a first case body 71 and a second case body 72 disposed on its opposite sides, two locksets 90 are respectively disposed on the first case body 71 and the second case body 72. Therefore, the manufacturing cost is rised and it is inconvenient in use since the users need to set and remember many sequences.

SUMMARY OF THE INVENTION

The present invention generally relates to a lockset.

The lockset of the present invention includes a first body, a second body, and a third body. The first body includes a connecting part, a first A part, and a first B part. The first A part is disposed in one end of the connecting part, wherein the first A part includes a first A lock body, a first A upper face, and a first A side face. The first A lock body is disposed in the first A part. The first A upper face has a first A lock hole. The first A side face has a first A positioning hole, wherein there is a first A angle between the first A upper face and the first A side face. The first B part is disposed in the other end of the connecting part, wherein the first B part includes a first B upper face and a first B side face. The first B upper face has a first B lock hole, wherein the first A upper face and the first B upper face both face the same direction. The first B side face has a first B positioning hole, wherein the first A side face and the first B side face the opposite directions, wherein there is a first B angle between the first B upper face and the first B side face. The second body includes a second upper face and a second side face. The first A upper face and the second upper face both face the same direction. A second rotatable buckle having a second rotating unit and a second lock unit is disposed on the second upper face. One end of the second rotating unit is pivotally connected with the second upper face. The side of the other end of the second rotating unit facing the second upper face is connected with the second lock unit. The second side face faces the first A side face. A second positioning unit is disposed in a position on the second side face corresponding to the first A positioning hole. There is a second angle between the second upper face and the second side face. The third body includes a third upper face and a third side face. The first B upper face and the third upper face both face the same direction. A third rotatable buckle having a third rotating unit and a third lock unit is disposed on the third upper face. One end of the third rotating unit is pivotally connected with the third upper face. The side of the other end of the third rotating unit facing the third upper face is connected with the third lock unit. The third side face faces the first B side face. A third positioning unit is disposed in a position on the third side face corresponding to the first B positioning hole. There is a third angle between the third upper face and the third side face. When the first A side face is in a first A lock position adjacent to the second side face, the second positioning unit inserts into the first A positioning hole, and the second rotatable unit is rotated to insert the second lock unit into the first A lock hole, wherein the first A lock body restricts the second lock unit from leaving the first A lock hole. When the first B side face is in a first B lock position adjacent to the third side face, the third positioning unit inserts into the first B positioning hole, and the third rotatable unit is rotated to insert the third lock unit into the first B lock hole.

The first body further includes a first B lock body disposed in the first B part, wherein when the first B side face is in the first B lock position, the third rotatable unit is rotated to insert the third lock unit into the first B lock hole, and the first B lock body restricts the third lock unit from leaving the first B lock hole.

The first A lock body is a combination lock having a plurality of discs, wherein the plurality of discs are exposed by the first A upper face and share a pivot.

The lockset includes a first body, a second body, and a third body. The first body includes a connecting part, a first A part, and a first B part. A lock body is disposed in the connecting part. The first A part is disposed in one end of the connecting part, wherein the first A part includes a first A upper face and a first A side face. The first A upper face has a first A lock hole. The first A side face has a first A positioning hole, wherein there is a first A angle between the first A upper face and the first A side face. The first B part is disposed in the other end of the connecting part, wherein the first B part includes a first B upper face and a first B side face. The first B upper face has a first B lock hole, wherein the first A upper face and the first B upper face both face the same direction. The first B side face has a first B positioning hole, wherein the first A side face and the first B side face the opposite directions, wherein there is a first B angle between the first B upper face and the first B side face. The second body includes a second upper face and a second side face. The first A upper face and the second upper face both face the same direction. A second rotatable buckle having a second rotating unit and a second lock unit is disposed on the second upper face. One end of the second rotating unit is pivotally connected with the second upper face. The side of the other end of the second rotating unit facing the second upper face is connected with the second lock unit. The second side face faces the first A side face. A second positioning unit is disposed in a position on the second side face corresponding to the first A positioning hole. There is a second angle between the second upper face and the second side face. The third body includes a third upper face and a third side face. The first B upper face and the third upper face both face the same direction. A third rotatable buckle having a third rotating unit and a third lock unit is disposed on the third upper face. One end of the third rotating unit is pivotally connected with the third upper face. The side of the other end of the third rotating unit facing the third upper face is connected with the third lock unit. A third side face faces the first B side face. A third positioning unit is disposed in a position on the third side face corresponding to the first B positioning hole. There is a third angle between the third upper face and the third side face. When the first A side face is in a first A lock position adjacent to the second side face, the second positioning unit inserts into the first A positioning hole, and the second rotatable unit is rotated to insert the second lock unit into the first A lock hole, wherein the lock body restricts the second lock unit from leaving the first A lock hole. When the first B side face is in a first B lock position adjacent to the third side face, the third positioning unit inserts into the first B positioning hole, and the third rotatable unit is rotated to insert the third lock unit into the first B lock hole, wherein the lock body restricts the third lock unit from leaving the first B lock hole.

The lockset includes a first body, a second body, and a third body. The first body includes a first lock body, a first upper face, and a first side face. The first lock body is disposed in the first body. The first upper face has a first lock hole. The first side face has a first positioning hole, wherein there is a first angle between the first upper face and the first side face. The second body includes a connecting part, a second A part, and a second B part. The second A part is disposed in one end of the connecting part near the first body, wherein the second A part includes a second A upper face and a second A side face. The first upper face and the second A upper face both face the same direction. A second A rotatable buckle having a second A rotating unit and a second A lock unit is disposed on the second A upper face. One end of the second A rotating unit is pivotally connected with the second A upper face. The side of the other end of the second A rotating unit facing the second A upper face is connected with the second A lock unit. The second A side face faces the first side face. A second A positioning unit is disposed in a position on the second A side face corresponding to the first positioning hole. There is a second A angle between the second A upper face and the second A side face. The second B part is disposed in the other end of the connecting part with respect to the first body, wherein the second B part includes a second B upper face and a second B side face. The first upper face and the second B upper face both face the same direction. A second B rotatable buckle having a second B rotating unit and a second B lock unit is disposed on the second B upper face. One end of the second B rotating unit is pivotally connected with the second B upper face. The side of the other end of the second B rotating unit facing the second B upper face is connected with the second B lock unit. The second B side face is disposed on the opposite side of the second body with respect to the second A side face. A second B positioning unit is disposed in a position on the second B side face. There is a second B angle between the second B upper face and the second B side face. The third body includes a third upper face and a third side face. The third upper face has a third lock hole. The third side face has a third positioning hole corresponding to the second B positioning unit. There is a third angle between the third upper face and the third side face. When the first side face is in a first lock position adjacent to the second A side face, the second A positioning unit inserts into the first positioning hole, and the second A rotatable unit is rotated to insert the second A lock unit into the first lock hole, wherein the first lock body restricts the second A lock unit from leaving the first lock hole. When the third side face is in a third lock position adjacent to the second B side face, the second B positioning unit inserts into the third positioning hole, and the second B rotatable unit is rotated to insert the second B lock unit into the third lock hole.

The third body further includes a third lock body disposed in the third body, wherein when the third side face is in the third lock position, the second B rotatable unit is rotated to insert the second B lock unit into the third lock hole, and the third lock body restricts the second B lock unit from leaving the third lock hole.

The lockset includes a first body, a second body, and a third body. The first body includes a first upper face and a first side face. The first upper face has a first lock hole. The first side face has a first positioning hole, wherein there is a first angle between the first upper face and the first side face. The second body includes a connecting part, a second A part, and a second B part. The second A part is disposed in one end of the connecting part near the first body, wherein the second A part includes a second A lock body, a second A upper face, and a second A side face. The second A lock body is disposed in the second A part. The first upper face and the second A upper face both face the same direction. A second A rotatable buckle having a second A rotating unit and a second A lock unit is disposed on the second A upper face. One end of the second A rotating unit is pivotally connected with the second A upper face. The side of the other end of the second A rotating unit facing the second A upper face is connected with the second A lock unit. The second A side face faces the first side face. A second A positioning unit is disposed in a position on the second A side face corresponding to the first positioning hole. There is a second A angle between the second A upper face and the second A side face. The second B part is disposed in the other end of the connecting part with respect to the first body, wherein the second B part includes a second B upper face and a second B side face. The first upper face and the second B upper face both face the same direction. A second B rotatable buckle having a second B rotating unit and a second B lock unit is disposed on the second B upper face. One end of the second B rotating unit is pivotally connected with the second B upper face. The side of the other end of the second B rotating unit facing the second B upper face is connected with the second B lock unit. The second B side face is disposed on the opposite side of the second body with respect to the second A side face. A second B positioning unit is disposed in a position on the second B side face. There is a second B angle between the second B upper face and the second B side face. The third body includes a third upper face and a third side face. The third upper face has a third lock hole. The third side face has a third positioning hole corresponding to the second B positioning unit. There is a third angle between the third upper face and the third side face. When the first side face is in a first lock position adjacent to the second A side face, the second A positioning unit inserts into the first positioning hole, and the second A rotatable unit is rotated to insert the second A lock unit into the first lock hole, wherein the second A lock body restricts the second A lock unit from leaving the first lock hole. When the third side face is in a third lock position adjacent to the second B side face, the second B positioning unit inserts into the third positioning hole, and the second B rotatable unit is rotated to insert the second B lock unit into the third lock hole.

The second B part further includes a second B lock body disposed in the second B part, wherein when the third side face is in the third lock position, the second B rotatable unit is rotated to insert the second B lock unit into the third lock hole, and the second B lock body restricts the second B lock unit from leaving the third lock hole.

The connecting part is retractable.

The lockset is for use with a case, wherein the case includes a middle part, a first case body and a second case body. The first case body and the second case body are disposed respectively on the opposite sides of the middle part. The connecting part is disposed on the surface of the middle part.

DETAILED DESCRIPTION OF THE INVENTION

Figure 1A:
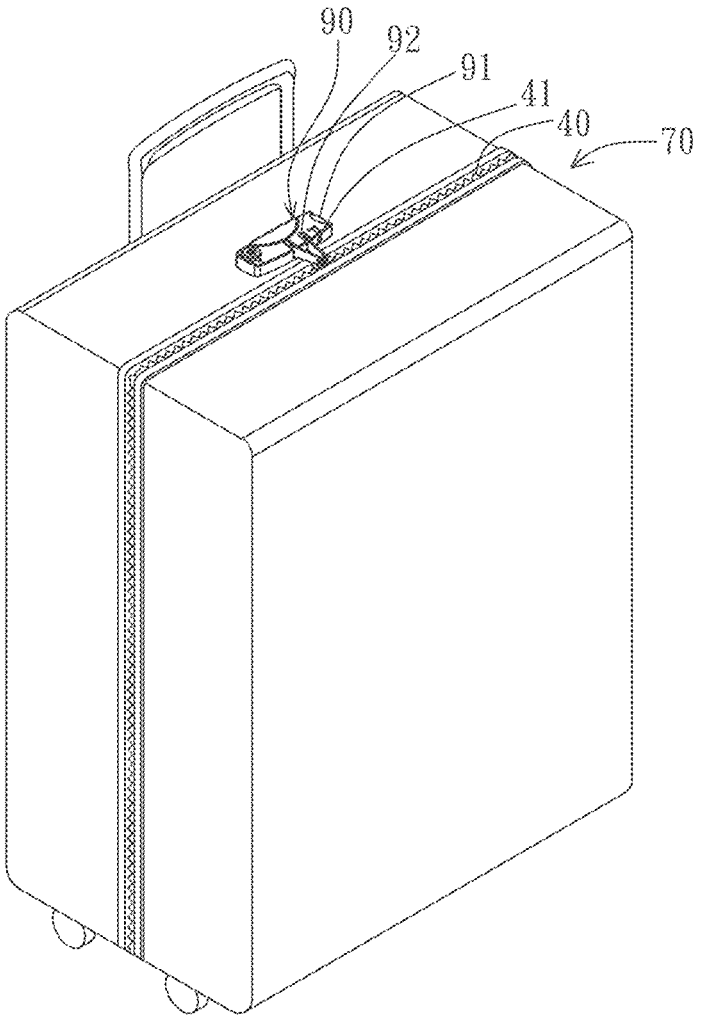
FIG. 1A (PRIOR ART)
FIGS. 1A and 1B are perspective views of prior arts.
Figure 1B:
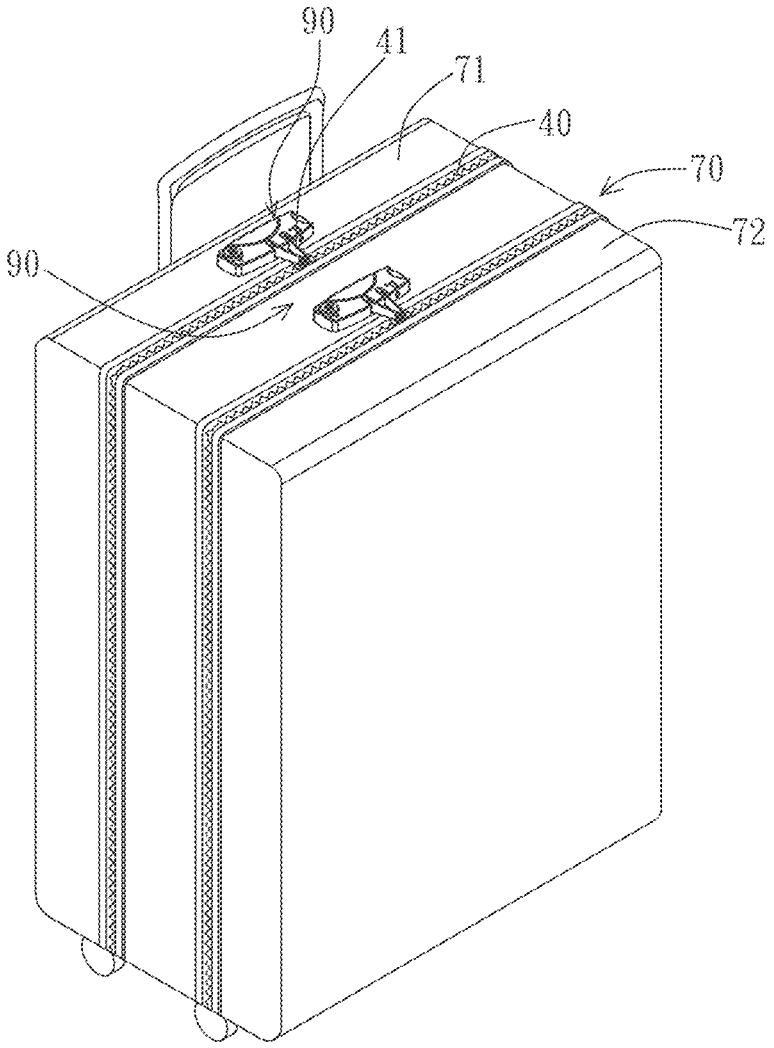
FIG. 1B (PRIOR ART)
Figure 2:
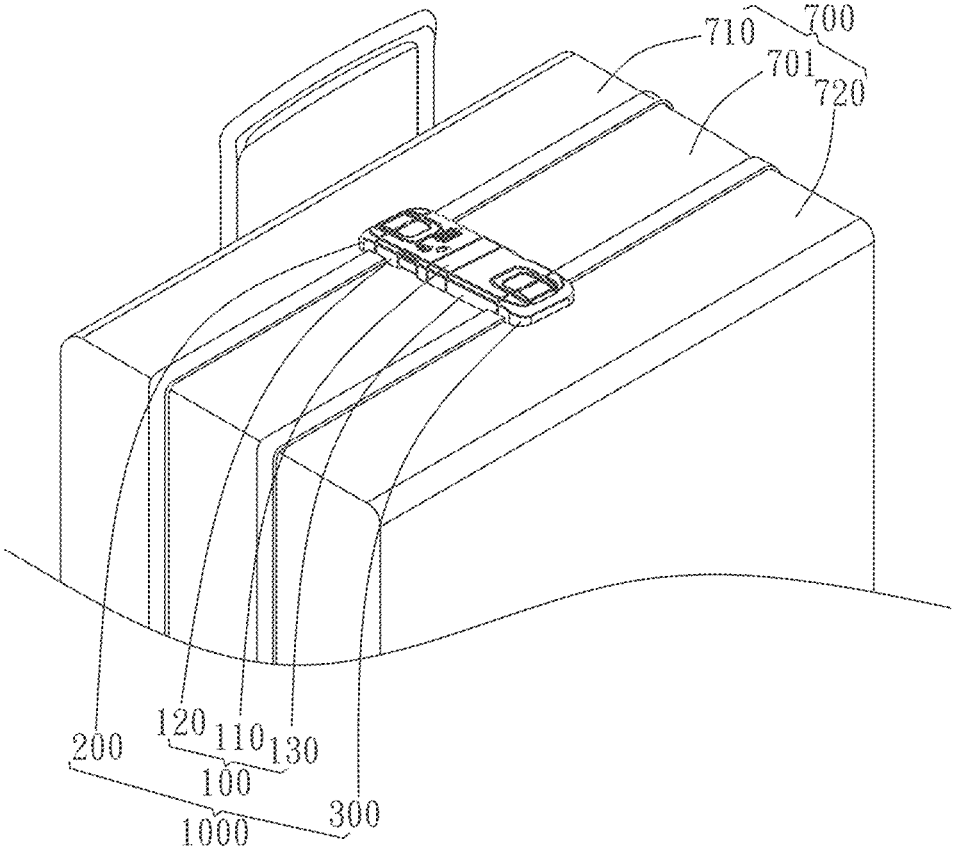
FIG. 2 is a perspective view of an embodiment of the invention used with a case.

As the embodiment shown in FIG. 2, the lockset 1000 of the present invention is for use with a case 700. In this embodiment, the case 700 is a luggage case including a middle part 701, a first case body 710 and a second case body 720. The first case body 710 and the second case body 720 are disposed respectively on the opposite sides of the middle part 701. The connecting part 110 of the present invention is disposed on the surface of the middle part 701. In other embodiments, the case could be a suitcase or a briefcase.

More particularly, as the embodiment shown in FIG. 2, the lockset 1000 of the present invention includes a first body 100, a second body 200, and a third body 300. The first body 100 includes a connecting part 110, a first A part 120, and a first B part 130. The connecting part 110, the first A part 120, and the first B part 130 are disposed respectively on the surfaces of the middle part 701, the first case body 710, and the second case body 720.

Figure 3A:
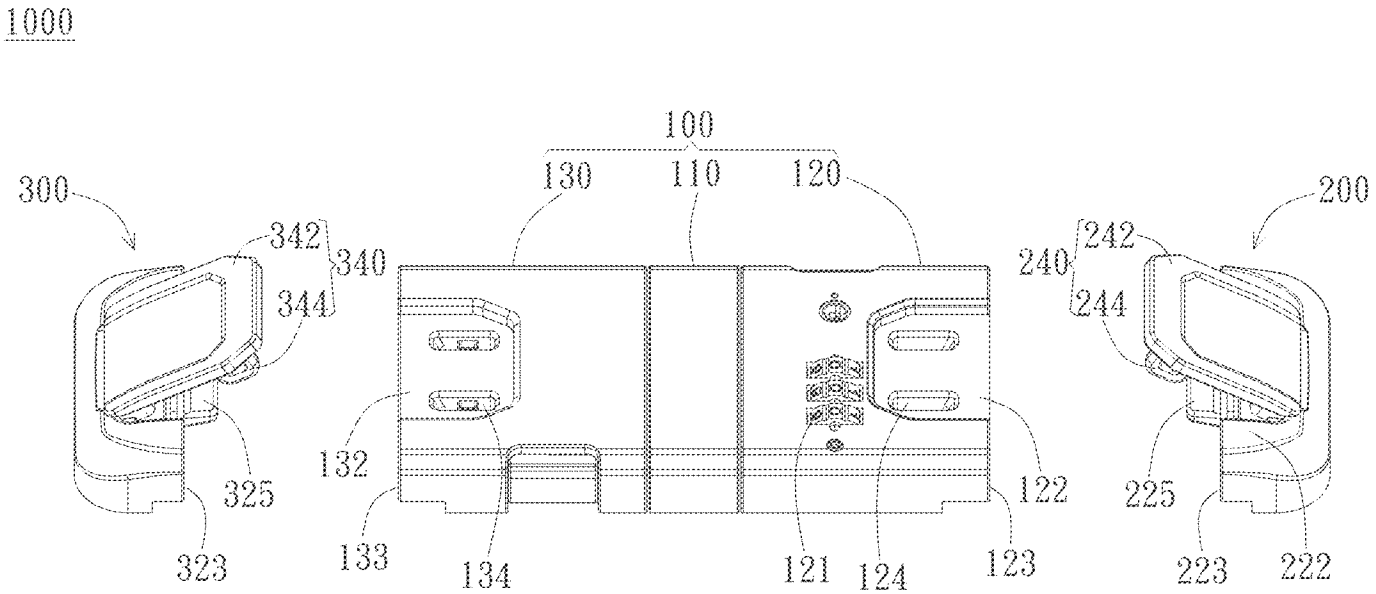
FIGS. 3A-3C are perspective views of embodiments of the present invention.
Figure 3B:
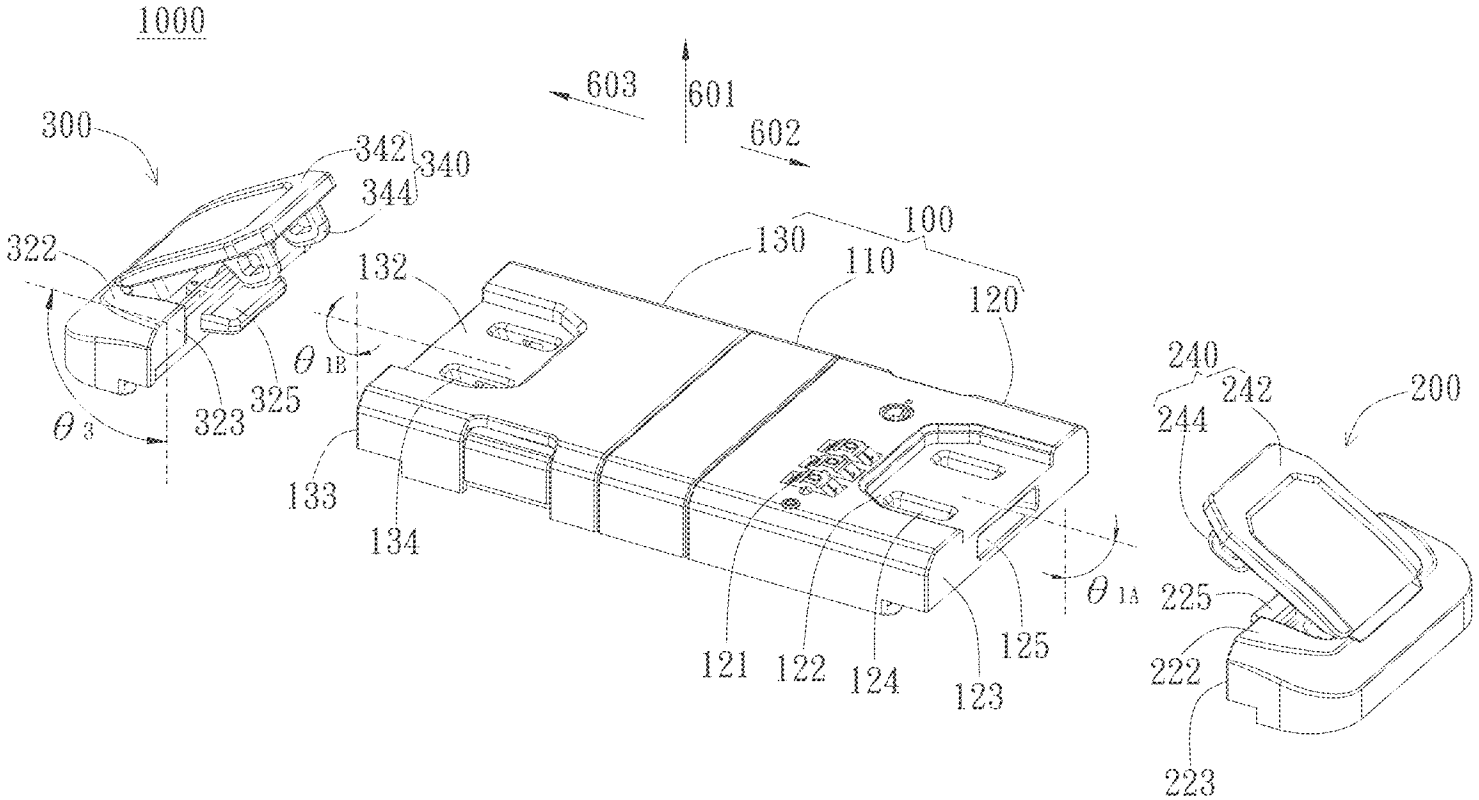
Figure 3C:
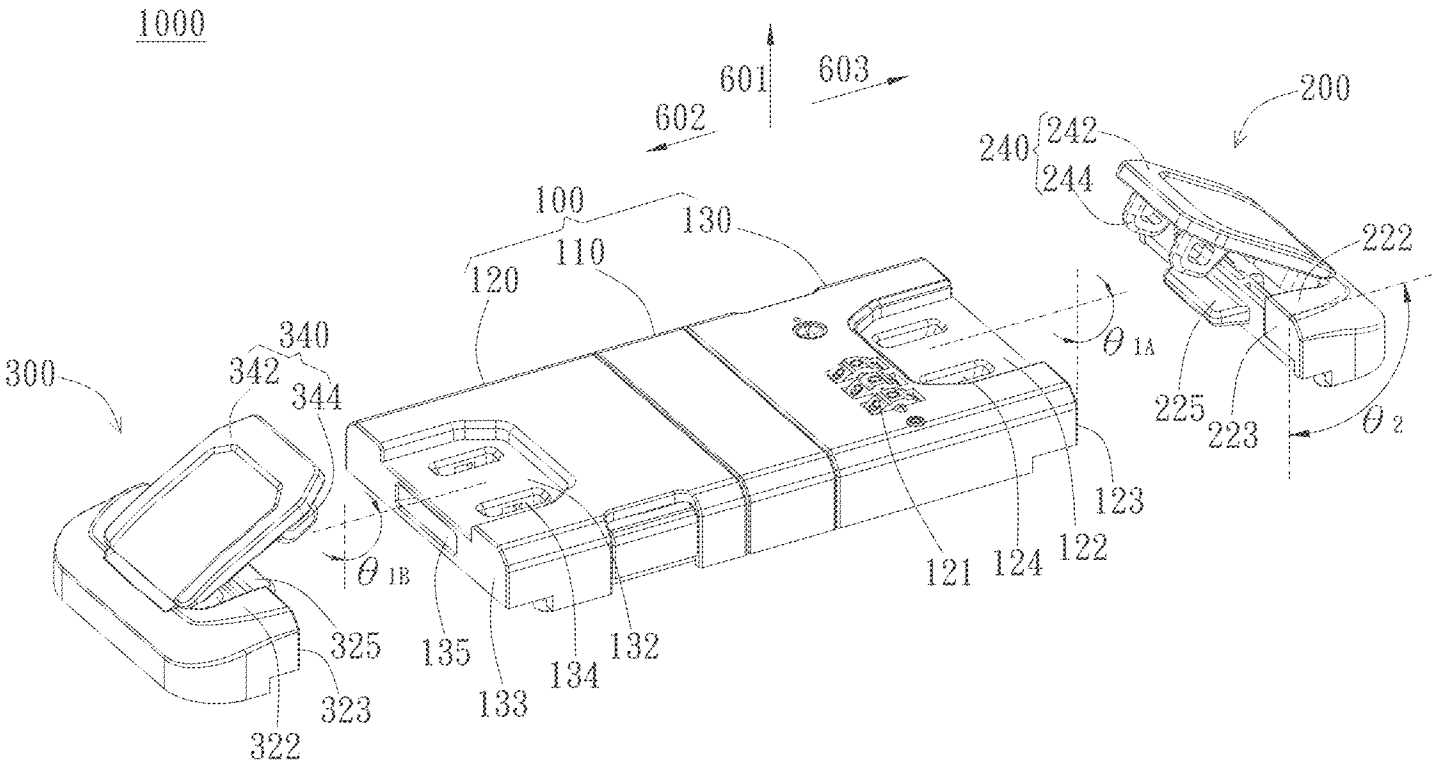

As the embodiment shown in FIGS. 3A-3C, the first A part 120 is disposed in one end of the connecting part 110, wherein the first A part 120 includes a first A lock body 121, a first A upper face 122, and a first A side face 123. The first A lock body 121 is disposed in the first A part 120. In this embodiment, the first A lock body 121 is a combination lock having a plurality of discs, wherein the plurality of discs are exposed by the first A upper face 122. In different embodiments, however, the first A lock body can be other types of locks, e.g. key locks, Near Field Communication (NFC) proximity locks, fingerprint identification locks, etc. The first A upper face 122 has a first A lock hole 124. More particularly, the first A lock hole is disposed in the cancave on the first A upper face 122. The first A side face 123 has a first A positioning hole 125, wherein there is a first A angle $\theta_{1A}$ between the first A upper face 122 and the first A side face 123. The first A angle $\theta_{1A}$ is preferably 90°.

The first B part 130 is disposed in the other end of the connecting part 110, wherein the first B part 130 includes a first B upper face 132 and a first B side face 133. The first B upper face 132 has a first B lock hole 134, wherein the first A upper face 122 and the first B upper face 132 both face the same direction 601. The first A side face 123 and the first B side face 133 face the opposite directions. More particularly, the first A side face 123 and the first B side face 133 face respectively the opposite directions 602 and 603. The first B side face 133 has a first B positioning hole 135, wherein there is a first B angle $\theta_{1B}$ between the first B upper face 132 and the first B side face 133. The first B angle $\theta_{1B}$ is preferably 90°.

The second body 220 includes a second upper face 222 and a second side face 223. The first A upper face 122 and the second upper face 222 both face the same direction, which is direction 601 in this embodiment. A second rotatable buckle 240 having a second rotating unit 242 and a second lock unit 244 is disposed on the second upper face 222. One end of the second rotating unit 242 is pivotally connected with the second upper face 222. The side of the other end of the second rotating unit 242 facing the second upper face 222 is connected with the second lock unit 244. The second side face 223 faces the first A side face 123. A second positioning unit 225 is disposed in a position on the second side face 223 corresponding to the first A positioning hole 125. There is a second angle $\theta_2$ between the second upper face and the second side face. The second angle $\theta_2$ is preferably 90°.

The third body 300 includes a third upper face 322 and a third side face 323. The first B upper face 132 and the third upper face 322 both face the same direction, which is direction 601 in this embodiment. A third rotatable buckle 340 having a third rotating unit 342 and a third lock unit 344 is disposed on the third upper face 322. One end of the third rotating unit 342 is pivotally connected with the third upper face 322. The side of the other end of the third rotating unit 342 facing the third upper face 322 is connected with the third lock unit 344. The third side face 323 faces the first B side face 133. A third positioning unit 325 is disposed in a position on the third side face 323 corresponding to the first B positioning hole 135. There is a third angle $\theta_3$ between the third upper face 322 and the third side face 323. The third angle $\theta_3$ is preferably 90°.

Figure 3D:
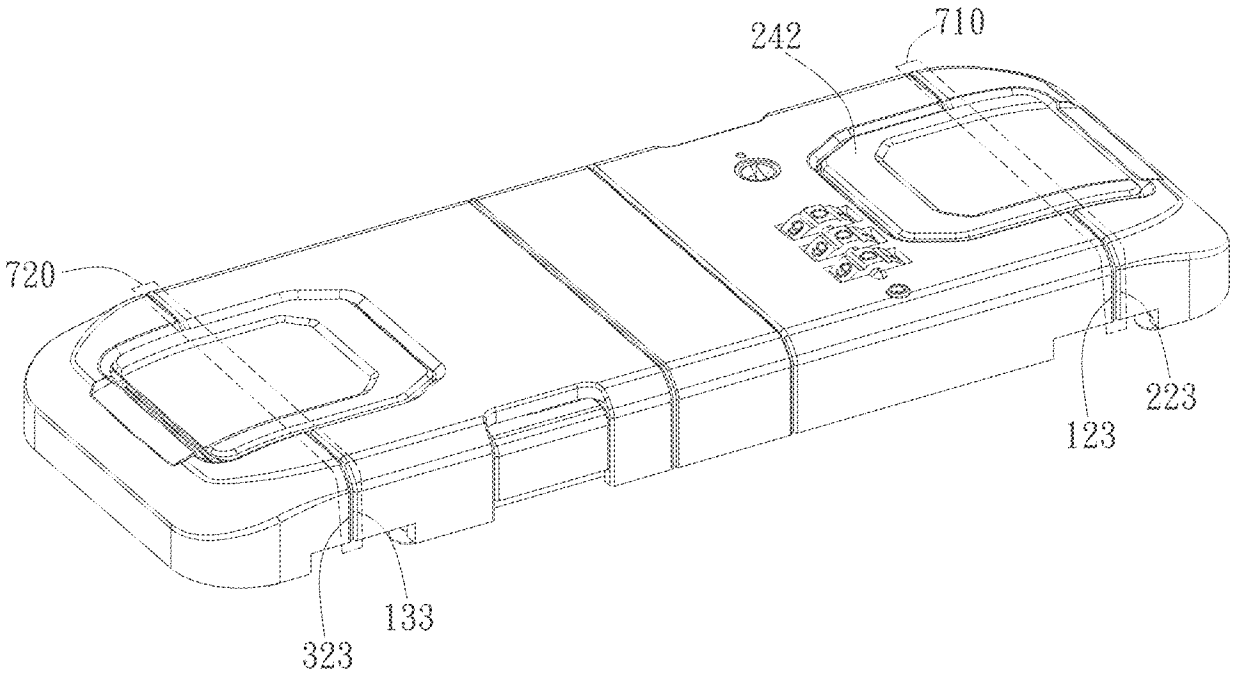
FIG. 3D is a perspective view to show that the first body, the second body and the third body cling with each other.

As the embodiment shown in FIG. 3D, when the first A side face 123 is in a first A lock position 710 adjacent to the second side face 223, the second positioning unit 225 inserts into the first A positioning hole 125 (see FIG. 3B), and the second rotatable unit 242 is rotated to insert the second lock unit 244 into the first A lock hole 124, wherein the first A lock body 121 restricts the second lock unit 244 from leaving the first A lock hole 124. As the embodiment shown in FIG. 3D, when the first B side face 133 is in a first B lock position 720 adjacent to the third side face 323, the third positioning unit 325 inserts into the first B positioning hole 135 (see FIG. 3C), and the third rotatable unit 342 is rotated to insert the third lock unit 344 into the first B lock hole 134.

Figure 4A:
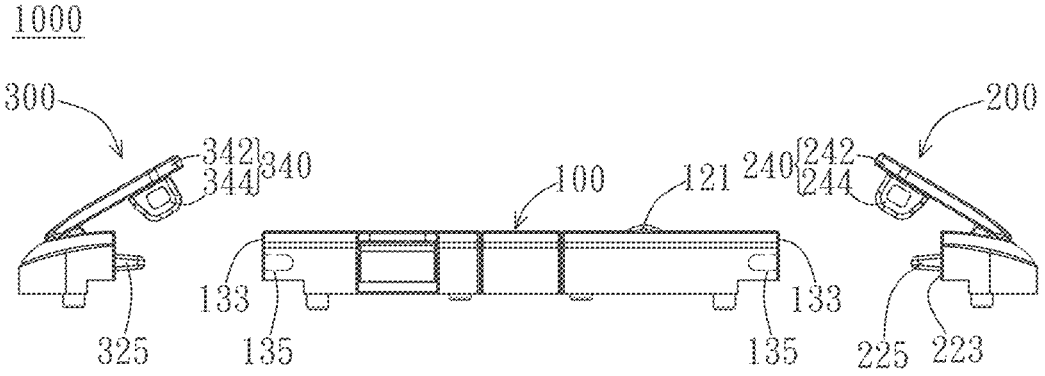
FIGS. 4A-4C are perspective views to show the movement of the lockset.
Figure 4B:
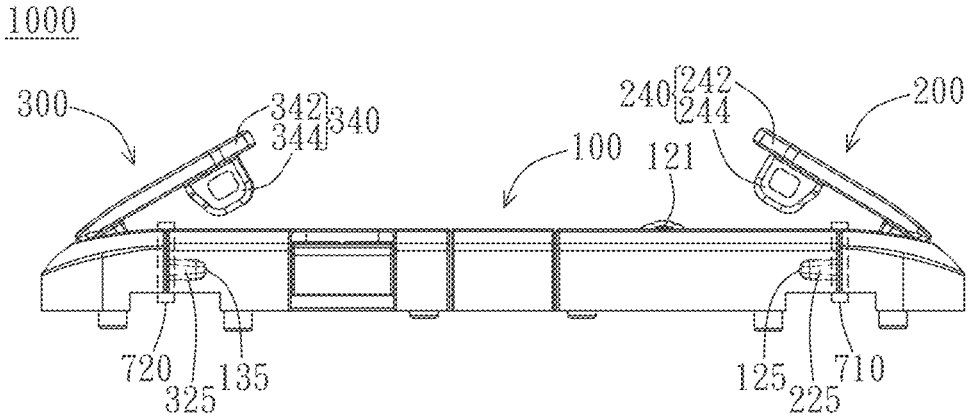
Figure 4C:
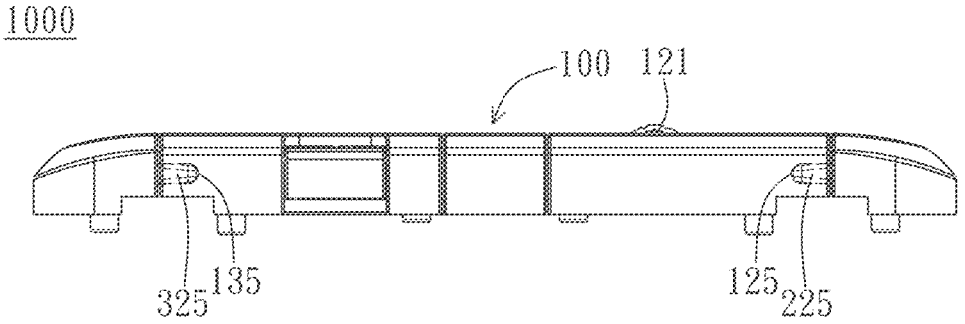

The operation of the lockset of the present invention is described further as following. As the embodiment shown in FIG. 4A, when second rotatable buckle 240 and the third rotatable buckle 340 are lifted toward direction 601, the second lock unit 244 and the third lock unit 344 have no contact with the first body 100. The second lock unit 244 and the third lock unit 344 are able to move freely with respect to the first body 100. To attain a lock-state of the lockset 1000, the second body 200 and the third body 300 is moved closer to first body 100 to reach the first A lock position 710 and the first B lock position 720, wherein the second positioning unit 225 is inserted into the first A positioning hole 125 (see FIG. 3B) and the third positioning unit 325 is inserted into the first B positioning hole 135 (see FIG. 3B). Then the second rotatable unit 242 and the third rotatable unit 340 is able to be rotated respectively to insert the second lock unit 244 and the third lock unit 344 into the first A lock hole 124 and the first B lock hole 134, as shown in FIG. 3D.

More particularly, when the first A lock body 121 is in the lock-state, a movable restricting unit (e.g. a pin or a latch) is disposed in the first A lock hole 124 to restrict the second lock unit 224 from leaving the first A lock hole 124 in order to achieve locking. On the other hand, since the third lock unit 344 inserts into the first B lock hole 134 at the same time, the lockset 1000 of the present invention is able to firmly lock the first case body 710 and to fix the second case body 720.

Figure 5:
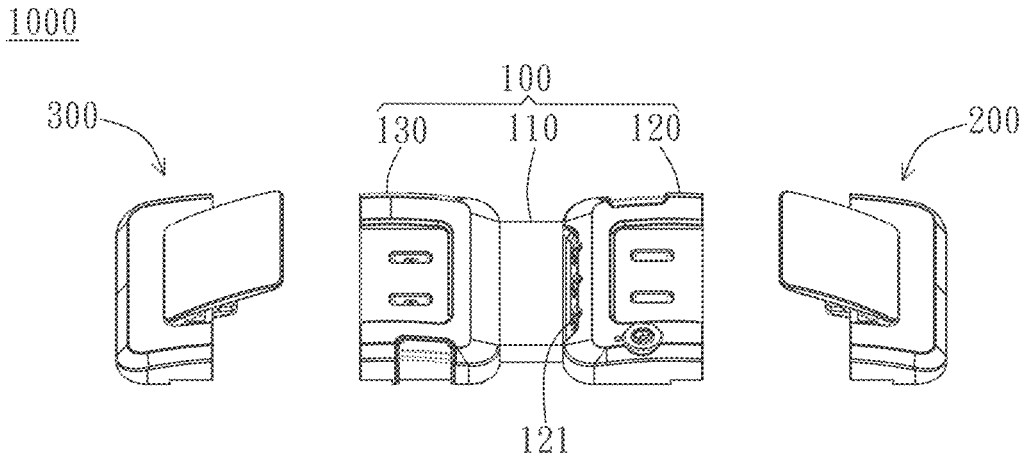
FIG. 5 is a perspective view to show the discs of the first A lock body disposed on a side of the first A part.

In this embodiment, the second lock unit and the third lock unit include annulations. In different embodiments, the lock unit may be different under different manufacturing or usage requirements. For example, the lock unit is a hook for reducing its size. On the other hand, as the embodiment shown in FIG. 3C, the discs of the first A lock body 121 are disposed on and protrude out of the first A upper face 122 along the direction 601, wherein the discs use the same pivot. In different embodiments, however, the discs of the first A lock body 121 face the other direction and are not limited to use the same pivot. As the embodiment shown in FIG. 5, the discs of the first A lock body 121 are disposed in the side of the first A part 120 facing the third body 300 and don't use the same pivot.

Figure 6A:
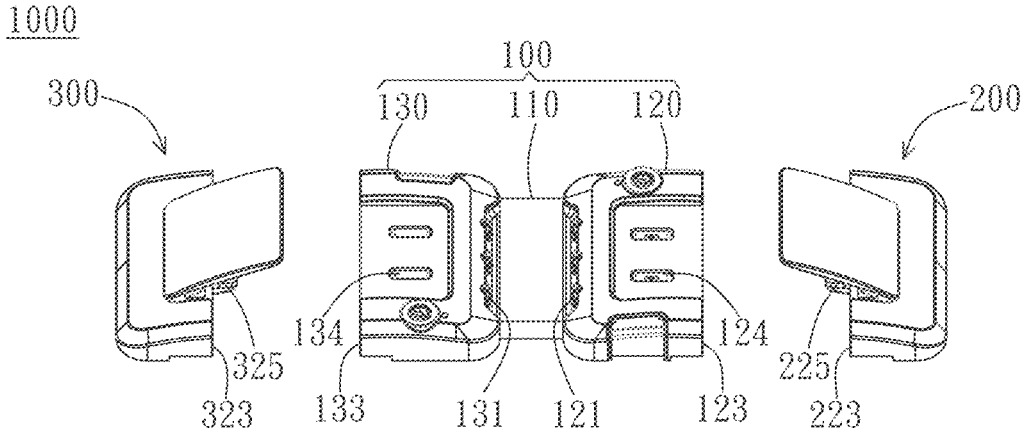
FIGS. 6A to 10 are perspective views of different embodiments of the invention.
Figure 6B:
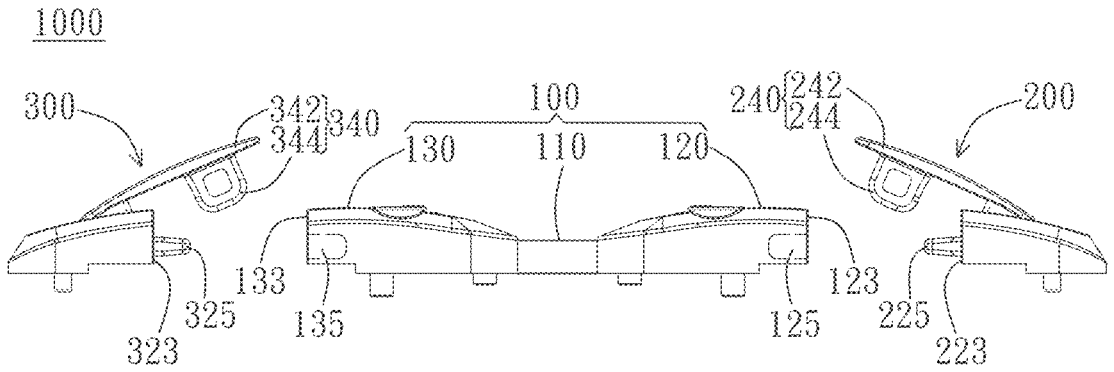

As the embodiment shown in FIGS. 6A and 6B, the first body 100 further includes a first B lock body 131 disposed in the first B part 130, wherein when the first B side face 133 is in the first B lock position 720 (see FIG. 3D), the third rotatable unit 342 is rotated to insert the third lock unit 344 into the first B lock hole 134, and the first B lock body 131 restricts the third lock unit 344 from leaving the first B lock hole 134. Hence, the lockset 1000 of the present invention is able to lock both the first case body 710 and the second case body 720 (see FIG. 2).

Figure 7A:
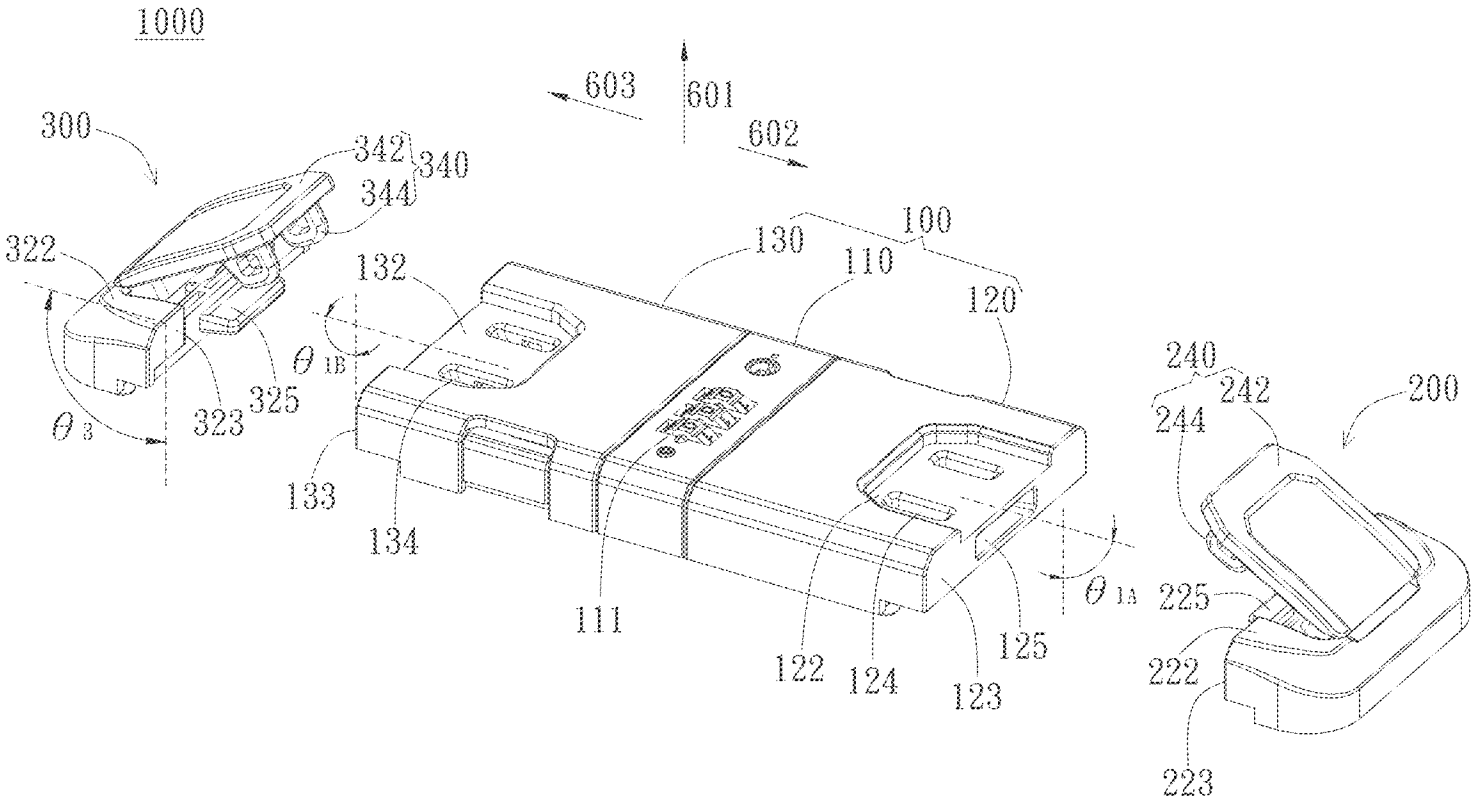
Figure 7B:
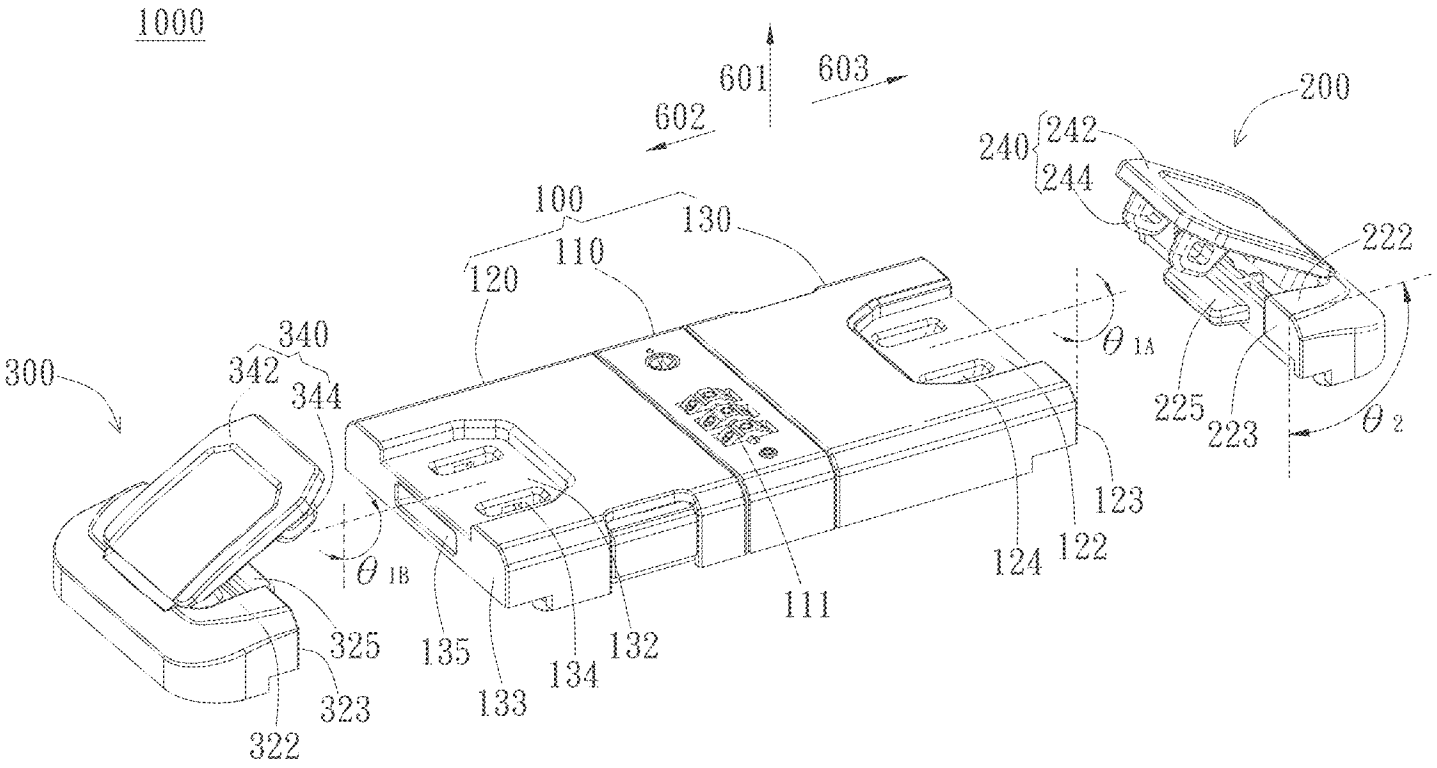

As shown in a different embodiment in FIGS. 7A and 7B, the lockset 1000 includes a first body 100, a second body 200, and a third body 300. The first body 100 includes a connecting part 110, a first A part 120, and a first B part 130. A lock body 111 is disposed in the connecting part 110. The first A part 120 is disposed in one end of the connecting part 110, wherein the first A part 120 includes a first A upper face 122 and a first A side face 123. The first A upper face 122 has a first A lock hole 124. The first A side face 123 has a first A positioning hole 125, wherein there is a first A angle $\theta_{1A}$ between the first A upper face 122 and the first A side face 123. The first B part 130 is disposed in the other end of the connecting part 110, wherein the first B part 130 includes a first B upper face 132 and a first B side face 133. The first B upper face 132 has a first B lock hole 134, wherein the first A upper face 122 and the first B upper face 132 both face the same direction. The first B side face 133 has a first B positioning hole 135, wherein the first A side face 123 and the first B side face 133 face the opposite direction, wherein there is a first B angle $\theta_{1B}$ between the first B upper face 132 and the first B side face 133.

The second body 200 includes a second upper face 222 and a second side face 223. The first A upper face 122 and the second upper face 222 both face the same direction. A second rotatable buckle 240 having a second rotating unit 242 and a second lock unit 244 is disposed on the second upper face 222. One end of the second rotating unit 242 is pivotally connected with the second upper face 222. The side of the other end of the second rotating unit 242 facing the second upper face 222 is connected with the second lock unit 244. The second side face 223 faces the first A side face 123. A second positioning unit 225 is disposed in a position on the second side face 223 corresponding to the first A positioning hole 125. There is a second angle $\theta_2$ between the second upper face 222 and the second side face 223.

The third body 300 includes a third upper face 322 and a third side face 323. The first B upper face 132 and the third upper face 322 both face the same direction. A third rotatable buckle 340 having a third rotating unit 342 and a third lock unit 344 is disposed on the third upper face 322. One end of the third rotating unit 342 is pivotally connected with the third upper face 322. The side of the other end of the third rotating unit 342 facing the third upper face 322 is connected with the third lock unit 344. A third side face 323 faces the first B side face 133. A third positioning unit 325 is disposed in a position on the third side face 323 corresponding to the first B positioning hole 135. There is a third angle $\theta_3$ between the third upper face 322 and the third side face 323.

When the first A side face 123 is in a first A lock position adjacent to the second side face 223, the second positioning unit 225 inserts into the first A positioning hole 125, and the second rotatable unit 242 is rotated to insert the second lock unit 244 into the first A lock hole 124, wherein the lock body 111 restricts the second lock unit 244 from leaving the first A lock hole 124. When the first B side face 133 is in a first B lock position adjacent to the third side face 323, the third positioning unit 325 inserts into the first B positioning hole 135, and the third rotatable unit 342 is rotated to insert the third lock unit 344 into the first B lock hole 134, wherein the lock body 111 restricts the third lock unit 344 from leaving the first B lock hole 134. More particularly, as the embodiments shown in FIGS. 7A and 7B, one single lock body 111 is used to achieve restricting the second lock unit 244 from leaving the first A lock hole 124 and restricting the third lock unit 344 from leaving the first B lock hole 134. Thus, the cost of disposing the lock body is reduced.

Figure 8A:
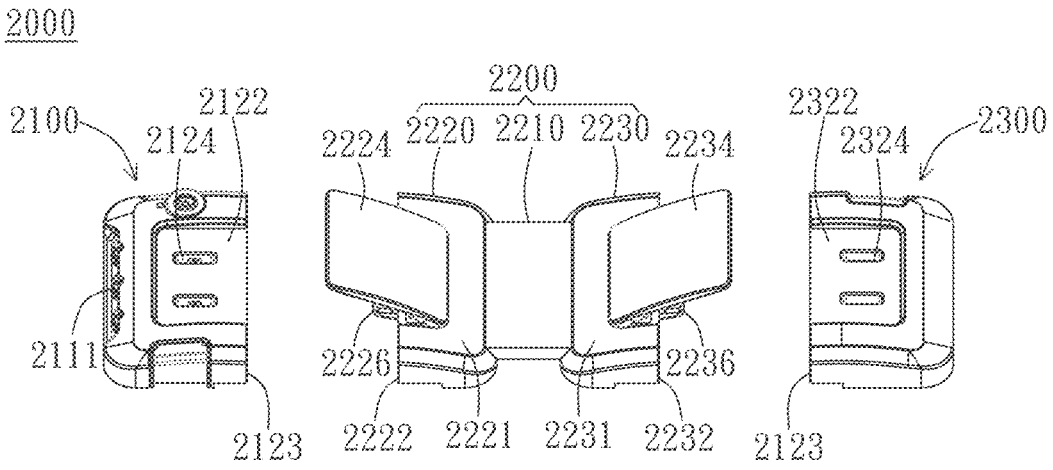
Figure 8B:
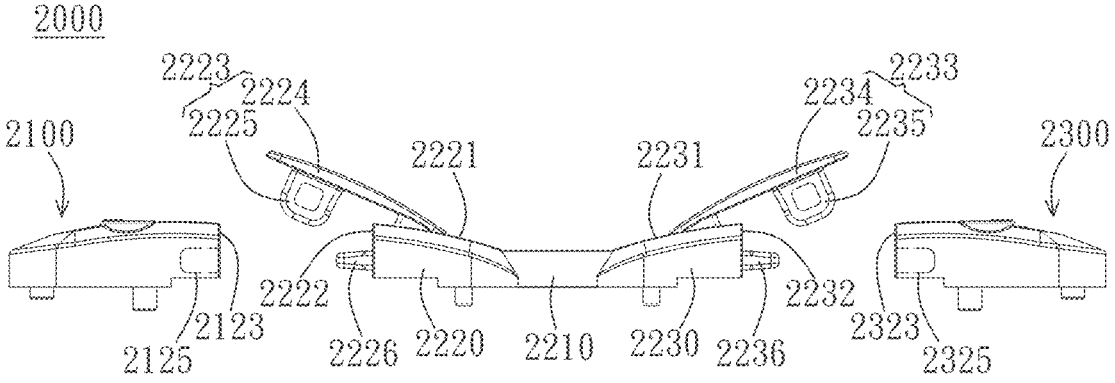
Figure 8C:
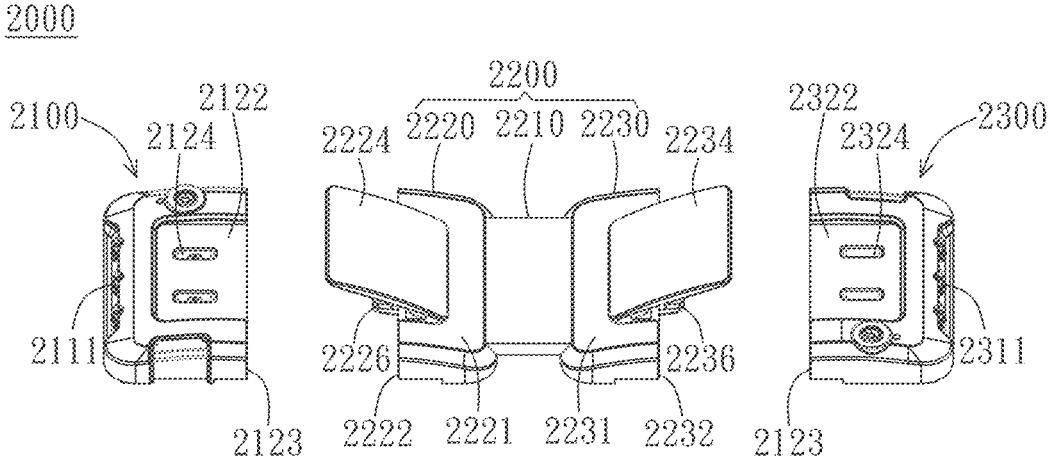

As shown in a different embodiment in FIGS. 8A and 8B, the lockset 2000 includes a first body 2100, a second body 2200, and a third body 2300. The first body 2100 includes a first lock body 2111, a first upper face 2122, and a first side face 2123. The first lock body 2111 is disposed in the first body 2100. The first upper face 2122 has a first lock hole 2124. The first side face 2123 has a first positioning hole 2125, wherein there is a first angle between the first upper face 2122 and the first side face 2123.

The second body 2200 includes a connecting part 2210, a second A part 2220, and a second B part 2230. The second A part 2220 is disposed in one end of the connecting part 2210 near the first body 2100, wherein the second A part 2220 includes a second A upper face 2221 and a second A side face 2222. The first upper face 2122 and the second A upper face 2221 both face the same direction. A second A rotatable buckle 2223 having a second A rotating unit 2224 and a second A lock unit 2225 is disposed on the second A upper face 2221. One end of the second A rotating unit 2224 is pivotally connected with the second A upper face 2221. The side of the other end of the second A rotating unit 2224 facing the second A upper face 2221 is connected with the second A lock unit 2225. The second A side face 2222 faces the first side face 2123. A second A positioning unit 2226 is disposed in a position on the second A side face 2222 corresponding to the first positioning hole 2125. There is a second A angle between the second A upper face 2221 and the second A side face 2222.

The second B part 2230 is disposed in the other end of the connecting part 2210 with respect to the first body 2100, wherein the second B part 2230 includes a second B upper face 2231 and a second B side face 2232. The first upper face 2122 and the second B upper face 2231 both face the same direction. A second B rotatable buckle 2233 having a second B rotating unit 2234 and a second B lock unit 2235 is disposed on the second B upper face 2231. One end of the second B rotating unit 2234 is pivotally connected with the second B upper face 2231. The side of the other end of the second B rotating unit 2234 facing the second B upper face 2231 is connected with the second B lock unit 2235. The second B side face 2232 is disposed on the opposite side of the second body 2200 with respect to the second A side face 2222. A second B positioning unit 2236 is disposed in a position on the second B side face 2232. There is a second B angle between the second B upper face 2231 and the second B side face 2232.

The third body 2300 includes a third upper face 2322 and a third side face 2323. The third upper face 2322 has a third lock hole 2324. The third side face 2323 has a third positioning hole 2325 corresponding to the second B positioning unit 2236. There is a third angle between the third upper face 2322 and the third side face 2323. When the first side face 2123 is in a first lock position adjacent to the second A side face 2222, the second A positioning unit 2226 inserts into the first positioning hole 2125, and the second A rotatable unit 2224 is rotated to insert the second A lock unit 2225 into the first lock hole 2124, wherein the first lock body 2111 restricts the second A lock unit 2225 from leaving the first lock hole 2124. When the third side face 2323 is in a third lock position adjacent to the second B side face 2232, the second B positioning unit 2236 inserts into the third positioning hole 2325, and the second B rotatable unit 2234 is rotated to insert the second B lock unit 2235 into the third lock hole 2324. On the other hand, the third body 2300 further includes a third lock body 2311 disposed in the third body 2300, wherein when the third side face 2323 is in the third lock position, the second B rotatable unit 2234 is rotated to insert the second B lock unit 2235 into the third lock hole 2324, and the third lock body 2311 restricts the second B lock unit 2235 from leaving the third lock hole 2324.

Figure 9A:
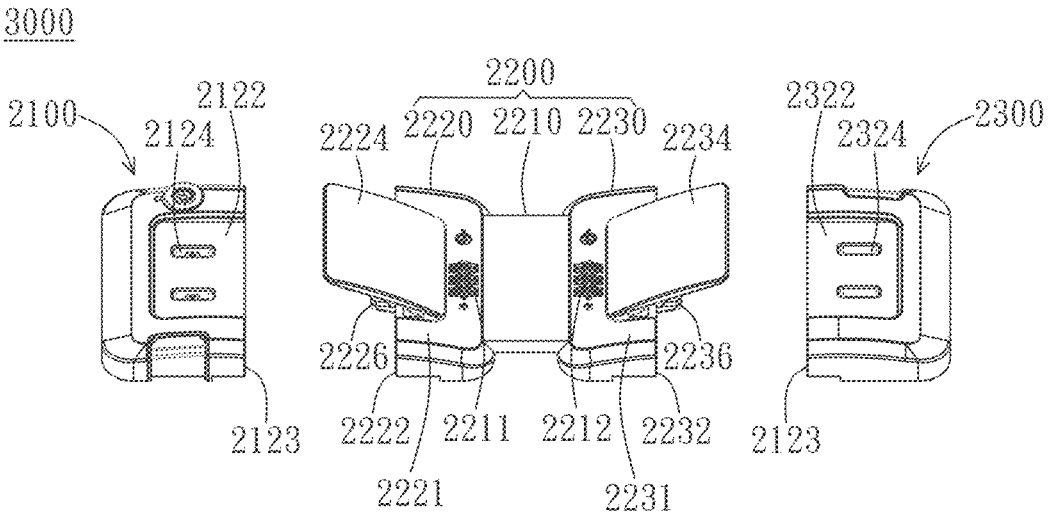
Figure 9B:
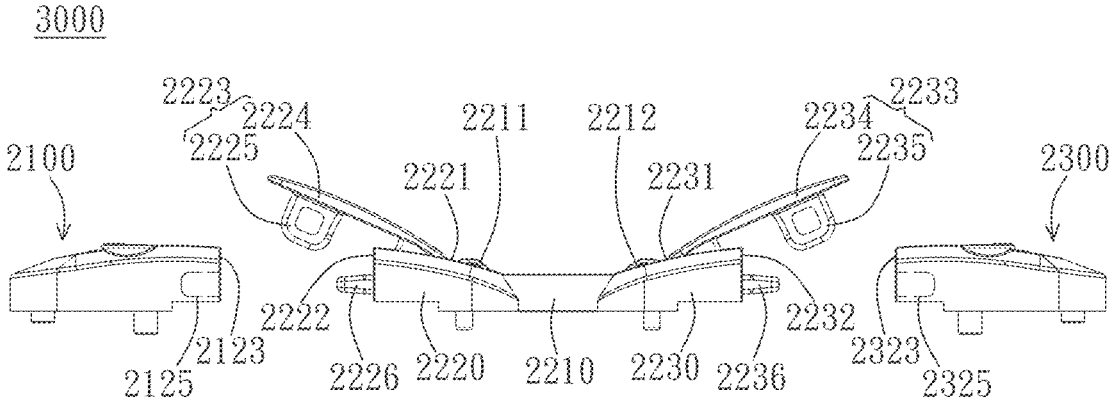

In different embodiments, the rotatable buckle can be disposed on the middle part of the lockset with the lock body. As shown in a different embodiment in FIGS. 9A and 9B, the lockset 3000 includes a first body 2100, a second body 2200, and a third body 2300. The first body 2100 includes a first upper face 2122 and a first side face 2123. The first upper face 2122 has a first lock hole 2124. The first side face 2123 has a first positioning hole 2125, wherein there is a first angle between the first upper face 2122 and the first side face 2123.

The second body 2200 includes a connecting part 2210, a second A part 2220, and a second B part 2230. The second A part 2220 is disposed in one end of the connecting part 2210 near the first body 2100, wherein the second A part 2220 includes a second A lock body 2211, a second A upper face 2221, and a second A side face 2222. The second A lock body 2211 is disposed in the second A part 2220. The first upper face 2122 and the second A upper face 2221 both face the same direction. A second A rotatable buckle 2223 having a second A rotating unit 2224 and a second A lock unit 2225 is disposed on the second A upper face 2221. One end of the second A rotating unit 2224 is pivotally connected with the second A upper face 2221. The side of the other end of the second A rotating unit 2224 facing the second A upper face 2221 is connected with the second A lock unit 2225. The second A side face 2222 faces the first side face 2123. A second A positioning unit 2226 is disposed in a position on the second A side face 2222 corresponding to the first positioning hole 2125. There is a second A angle between the second A upper face 2221 and the second A side face 2222. The second B part 2230 is disposed in the other end of the connecting part 2210 with respect to the first body 2100, wherein the second B part 2230 includes a second B upper face 2231 and a second B side face 2232. The first upper face 2122 and the second B upper face 2231 both face the same direction. A second B rotatable buckle 2233 having a second B rotating unit 2234 and a second B lock unit 2235 is disposed on the second B upper face 2231. One end of the second B rotating unit 2234 is pivotally connected with the second B upper face 2231. The side of the other end of the second B rotating unit 2234 facing the second B upper face 2231 is connected with the second B lock unit 2235. The second B side face 2232 is disposed on the opposite side of the second body 2200 with respect to the second A side face 2222. A second B positioning unit 2236 is disposed in a position on the second B side face 2232. There is a second B angle between the second B upper face 2231 and the second B side face 2232.

The third body includes a third upper face 2322 and a third side face 2323. The third upper face 2322 has a third lock hole 2324. The third side face 2323 has a third positioning hole 2325 corresponding to the second B positioning unit 2236. There is a third angle between the third upper face 2322 and the third side face 2323. When the first side face 2123 is in a first lock position adjacent to the second A side face 2222, the second A positioning unit 2226 inserts into the first positioning hole 2125, and the second A rotatable unit 2224 is rotated to insert the second A lock unit 2225 into the first lock hole 2124, wherein the second A lock body 2211 restricts the second A rotatable unit 2224 from rotating and hence restricts the second A lock unit 2225 from leaving the first lock hole 2124. When the third side face 2323 is in a third lock position adjacent to the second B side face 2232, the second B positioning unit 2236 inserts into the third positioning hole 2325, and the second B rotatable unit 2234 is rotated to insert the second B lock unit 2235 into the third lock hole 2324. On the other hand, the second B part 2230 further includes a second B lock body 2212 disposed in the second B part 2230, wherein when the third side face 2323 is in the third lock position, the second B rotatable unit 2234 is rotated to insert the second B lock unit 2235 into the third lock hole 2324, and the second B lock body 2212 restricts the second B lock unit 2235 from leaving the third lock hole 2324.

Figure 10:
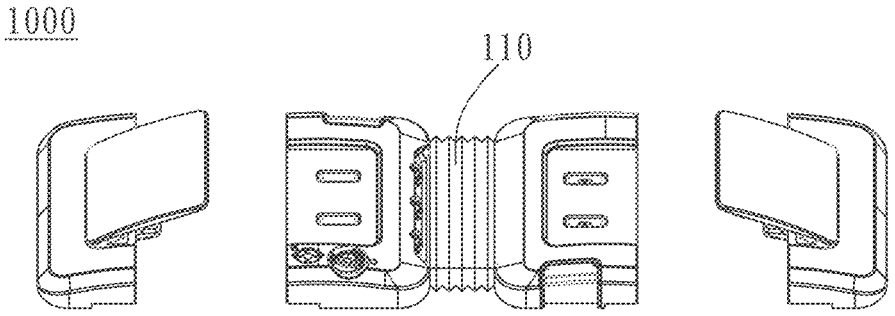

In the above-described embodiments shown in FIGS. 2 to 9B, the connecting part has a fixed shape. In different embodiments, however, connecting part is retractable to increase the flexibility of use. As the embodiment shown in FIG. 10, the connecting part 110 is a retractable polymer folding device.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A lockset, comprising:

a first body, including:

a connecting part;

a first A part disposed in one end of the connecting part, including:

a first A lock body disposed in the first A part;

a first A upper face having a first A lock hole;

a first A side face having a first A positioning hole, wherein there is a first A angle between the first A upper face and the first A side face;

a first B part disposed in the other end of the connecting part, including:

a first B upper face having a first B lock hole, wherein the first A upper face and the first B upper face both face the same direction;

a first B side face having a first B positioning hole, wherein the first A side face and the first B side face face the opposite directions, wherein there is a first B angle between the first B upper face and the first B side face;

a second body, including:

a second upper face, wherein the first A upper face and the second upper face both face the same direction, wherein a second rotatable buckle having a second rotating unit and a second lock unit is disposed on the second upper face, wherein one end of the second rotating unit is pivotally connected with the second upper face, wherein the side of the other end of the second rotating unit facing the second upper face is connected with the second lock unit;

a second side face facing the first A side face, wherein a second positioning unit is disposed in a position on the second side face corresponding to the first A positioning hole, wherein there is a second angle between the second upper face and the second side face;

a third body, including:

a third upper face, wherein the first B upper face and the third upper face both face the same direction, wherein a third rotatable buckle having a third rotating unit and a third lock unit is disposed on the third upper face, wherein one end of the third rotating unit is pivotally connected with the third upper face, wherein the side of the other end of the third rotating unit facing the third upper face is connected with the third lock unit;

a third side face facing the first B side face, wherein a third positioning unit is disposed in a position on the third side face corresponding to the first B positioning hole, wherein there is a third angle between the third upper face and the third side face;

when the first A side face is in a first A lock position adjacent to the second side face, the second positioning unit inserts into the first A positioning hole, and the second rotatable unit is rotated to insert the second lock unit into the first A lock hole, wherein the first A lock body restricts the second lock unit from leaving the first A lock hole;

when the first B side face is in a first B lock position adjacent to the third side face, the third positioning unit inserts into the first B positioning hole, and the third rotatable unit is rotated to insert the third lock unit into the first B lock hole.

2. The lockset of claim 1, wherein the first body further includes a first B lock body disposed in the first B part, wherein when the first B side face is in the first B lock position, the third rotatable unit is rotated to insert the third lock unit into the first B lock hole, and the first B lock body restricts the third lock unit from leaving the first B lock hole.

3. The lockset of claim 1, wherein the first A lock body is a combination lock having a plurality of discs, wherein the plurality of discs are exposed by the first A upper face and share a pivot.

4. The lockset of claim 1, wherein the connecting part is retractable.

5. The lockset of claim 1, wherein the lockset is for use with a case, wherein the case includes a middle part, a first case body and a second case body, wherein the first case body and the second case body are disposed respectively on the opposite sides of the middle part, wherein the connecting part is disposed on the surface of the middle part.

6. A lockset, comprising:

a first body, including:

a connecting part, wherein a lock body is disposed in the connecting part;

a first A part disposed in one end of the connecting part, including:

a first A upper face having a first A lock hole;

a first A side face having a first A positioning hole, wherein there is a first A angle between the first A upper face and the first A side face;

a first B part disposed in the other end of the connecting part, including:

a first B upper face having a first B lock hole, wherein the first A upper face and the first B upper face both face the same direction;

a first B side face having a first B positioning hole, wherein the first A side face and the first B side face face the opposite directions, wherein there is a first B angle between the first B upper face and the first B side face;

a second body, including:

a second upper face, wherein the first A upper face and the second upper face both face the same direction, wherein a second rotatable buckle having a second rotating unit and a second lock unit is disposed on the second upper face, wherein one end of the second rotating unit is pivotally connected with the second upper face, wherein the side of the other end of the second rotating unit facing the second upper face is connected with the second lock unit;

a second side face facing the first A side face, wherein a second positioning unit is disposed in a position on the second side face corresponding to the first A positioning hole, wherein there is a second angle between the second upper face and the second side face;

a third body, including:

a third upper face, wherein the first B upper face and the third upper face both face the same direction, wherein a third rotatable buckle having a third rotating unit and a third lock unit is disposed on the third upper face, wherein one end of the third rotating unit is pivotally connected with the third upper face, wherein the side of the other end of the third rotating unit facing the third upper face is connected with the third lock unit;

a third side face facing the first B side face, wherein a third positioning unit is disposed in a position on the third side face corresponding to the first B positioning hole, wherein there is a third angle between the third upper face and the third side face;

when the first A side face is in a first A lock position adjacent to the second side face, the second positioning unit inserts into the first A positioning hole, and the second rotatable unit is rotated to insert the second lock unit into the first A lock hole, wherein the lock body restricts the second lock unit from leaving the first A lock hole;

when the first B side face is in a first B lock position adjacent to the third side face, the third positioning unit inserts into the first B positioning hole, and the third rotatable unit is rotated to insert the third lock unit into the first B lock hole, wherein the lock body restricts the third lock unit from leaving the first B lock hole.

7. The lockset of claim 6, wherein the connecting part is retractable.

8. The lockset of claim 6, wherein the lockset is for use with a case, wherein the case includes a middle part, a first case body and a second case body, wherein the first case body and the second case body are disposed respectively on the opposite sides of the middle part, wherein the connecting part is disposed on the surface of the middle part.

9. A lockset, comprising:

a first body, including:

a first lock body disposed in the first body;

a first upper face having a first lock hole;

a first side face having a first positioning hole, wherein there is a first angle between the first upper face and the first side face;

a second body, including:

a connecting part;

a second A part disposed in one end of the connecting part near the first body, including:

a second A upper face, wherein the first upper face and the second A upper face both face the same direction, wherein a second A rotatable buckle having a second A rotating unit and a second A lock unit is disposed on the second A upper face, wherein one end of the second A rotating unit is pivotally connected with the second A upper face, wherein the side of the other end of the second A rotating unit facing the second A upper face is connected with the second A lock unit;

a second A side face facing the first side face, wherein a second A positioning unit is disposed in a position on the second A side face corresponding to the first positioning hole, wherein there is a second A angle between the second A upper face and the second A side face;

a second B part disposed in the other end of the connecting part with respect to the first body, including:

a second B upper face, wherein the first upper face and the second B upper face both face the same direction, wherein a second B rotatable buckle having a second B rotating unit and a second B lock unit is disposed on the second B upper face, wherein one end of the second B rotating unit is pivotally connected with the second B upper face, wherein the side of the other end of the second B rotating unit facing the second B upper face is connected with the second B lock unit;

a second B side face disposed on the opposite side of the second body with respect to the second A side face, wherein a second B positioning unit is disposed in a position on the second B side face, wherein there is a second B angle between the second B upper face and the second B side face;

a third body, including:

a third upper face having a third lock hole;

a third side face having a third positioning hole corresponding to the second B positioning unit, wherein there is a third angle between the third upper face and the third side face;

when the first side face is in a first lock position adjacent to the second A side face, the second A positioning unit inserts into the first positioning hole, and the second A rotatable unit is rotated to insert the second A lock unit into the first lock hole, wherein the first lock body restricts the second A lock unit from leaving the first lock hole;

when the third side face is in a third lock position adjacent to the second B side face, the second B positioning unit inserts into the third positioning hole, and the second B rotatable unit is rotated to insert the second B lock unit into the third lock hole.

10. The lockset of claim 9, wherein the third body further includes a third lock body disposed in the third body, wherein when the third side face is in the third lock position, the second B rotatable unit is rotated to insert the second B lock unit into the third lock hole, and the third lock body restricts the second B lock unit from leaving the third lock hole.

11. The lockset of claim 9, wherein the connecting part is retractable.

12. The lockset of claim 9, wherein the lockset is for use with a case, wherein the case includes a middle part, a first case body and a second case body, wherein the first case body and the second case body are disposed respectively on the opposite sides of the middle part, wherein the connecting part is disposed on the surface of the middle part.

13. A lockset, comprising:

a first body, including:

a first upper face having a first lock hole;

a first side face having a first positioning hole, wherein there is a first angle between the first upper face and the first side face;

a second body, including:

a connecting part;

a second A part disposed in one end of the connecting part near the first body, including:

a second A lock body disposed in the second A part;

a second A upper face, wherein the first upper face and the second A upper face both face the same direction, wherein a second A rotatable buckle having a second A rotating unit and a second A lock unit is disposed on the second A upper face, wherein one end of the second A rotating unit is pivotally connected with the second A upper face, wherein the side of the other end of the second A rotating unit facing the second A upper face is connected with the second A lock unit;

a second A side face facing the first side face, wherein a second A positioning unit is disposed in a position on the second A side face corresponding to the first positioning hole, wherein there is a second A angle between the second A upper face and the second A side face;

a second B part disposed in the other end of the connecting part with respect to the first body, including:

a second B upper face, wherein the first upper face and the second B upper face both face the same direction, wherein a second B rotatable buckle having a second B rotating unit and a second B lock unit is disposed on the second B upper face, wherein one end of the second B rotating unit is pivotally connected with the second B upper face, wherein the side of the other end of the second B rotating unit facing the second B upper face is connected with the second B lock unit;

a second B side face disposed on the opposite side of the second body with respect to the second A side face, wherein a second B positioning unit is disposed in a position on the second B side face, wherein there is a second B angle between the second B upper face and the second B side face;

a third body, including:

a third upper face having a third lock hole;

a third side face having a third positioning hole corresponding to the second B positioning unit, wherein there is a third angle between the third upper face and the third side face;

when the first side face is in a first lock position adjacent to the second A side face, the second A positioning unit inserts into the first positioning hole, and the second A rotatable unit is rotated to insert the second A lock unit into the first lock hole, wherein the second A lock body restricts the second A lock unit from leaving the first lock hole;

when the third side face is in a third lock position adjacent to the second B side face, the second B positioning unit inserts into the third positioning hole, and the second B rotatable unit is rotated to insert the second B lock unit into the third lock hole.

14. The lockset of claim 13, wherein the second B part further includes a second B lock body disposed in the second B part, wherein when the third side face is in the third lock position, the second B rotatable unit is rotated to insert the second B lock unit into the third lock hole, and the second B lock body restricts the second B lock unit from leaving the third lock hole.

15. The lockset of claim 13, wherein the connecting part is retractable.

16. The lockset of claim 13, wherein the lockset is for use with a case, wherein the case includes a middle part, a first case body and a second case body, wherein the first case body and the second case body are disposed respectively on the opposite sides of the middle part, wherein the connecting part is disposed on the surface of the middle part.

* * * * *